US009236179B1

(12) United States Patent
Folker et al.

(10) Patent No.: US 9,236,179 B1
(45) Date of Patent: Jan. 12, 2016

(54) MAGNETIC COMPONENT APPARATUS WITH INTERCONNECTABLE BOBBINS

(71) Applicant: Universal Lighting Technologies, Inc., Madison, AL (US)

(72) Inventors: Donald Folker, Madison, AL (US); Mike LeBlanc, Huntsville, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 14/091,038

(22) Filed: Nov. 26, 2013

(51) Int. Cl.

| | |
|---|---|
| ***H01F 27/30*** | (2006.01) |
| ***H01F 27/24*** | (2006.01) |
| ***H01F 27/28*** | (2006.01) |
| ***H01F 7/06*** | (2006.01) |
| ***H01F 27/06*** | (2006.01) |
| ***H01F 41/02*** | (2006.01) |
| ***H01F 41/06*** | (2006.01) |

(52) U.S. Cl.
CPC ..... *H01F 27/06* (2013.01); *H01F 41/02* (2013.01); *H01F 41/0625* (2013.01)

(58) Field of Classification Search
CPC ..... H01F 27/06; H01F 27/324; H01F 27/325; H01F 27/326; H01F 2005/02; H01F 2005/022; H01F 2005/025; H01F 2005/027; H01F 41/02; H01F 41/06; H01F 41/125; H01F 5/02
USPC ..... 336/198, 208, 212, 187, 170
See application file for complete search history.

(56) References Cited

U.S. PATENT DOCUMENTS

| | | | | |
|---|---|---|---|---|
| 3,218,592 | A * | 11/1965 | Barrick | 336/198 |
| 7,154,366 | B2 * | 12/2006 | Hsueh et al. | 336/198 |
| 2004/0246089 | A1 * | 12/2004 | Stephens | 336/212 |
| 2007/0290781 | A1 * | 12/2007 | Chen et al. | 336/185 |
| 2008/0088403 | A1 * | 4/2008 | Suzuki et al. | 336/198 |
| 2008/0284550 | A1 * | 11/2008 | Shinmen et al. | 336/155 |

FOREIGN PATENT DOCUMENTS

| | | |
|---|---|---|
| JP | 55145306 | 11/1980 |

* cited by examiner

*Primary Examiner* — Mangtin Lian
(74) *Attorney, Agent, or Firm* — Patterson Intellectual Property Law, P.C.; Mark J. Patterson; Jerry Turner Sewell

(57) ABSTRACT

An interconnectable bobbin has first and second end flanges and a fastener on the first end flange positioned to engage a second bobbin on an adjacent leg of a multiple leg magnetic core. A magnetic component apparatus includes one or more of the interconnectable bobbins, the magnetic component apparatus including a magnetic core with first and second legs, the first leg extending into a first bobbin, and the second leg extending into a second bobbin, wherein the first and second bobbins are fastened together.

13 Claims, 11 Drawing Sheets

MAGNETIC COMPONENT APPARATUS WITH INTERCONNECTABLE BOBBINS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

None

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to magnetic component structures that include wire windings around magnetic cores. Windings around a magnetic core produce a magnetic flux in core that can have an effect on current flow in other windings on the magnetic core. Such structures may be used in circuits as transformers or as inductors.

More particularly, this invention pertains to magnetic component structures having a magnetic core with multiple legs, with one or more windings on multiple legs. Typically, such magnetic components have magnetic cores that include one or more bobbins fixed to the cores. The location of the bobbins can be altered as necessary to facilitate different uses and different circuits. Typically these magnetic cores and bobbins are combined as one structure. It can be difficult to wind wire around such structures, as the bobbins can get in the way of each other during the winding process. This difficulty also increases when the magnetic core has multiple legs, as one leg will interfere with winding wire around a bobbin on another leg.

Additionally, when the bobbins and magnetic cores are one structure, each bobbin configuration on the core is a different structure, and accordingly, each structure must be manufactured separately. If the magnetic components are manufactured by injection molding for example, a different mold form must be made for each bobbin configuration. This can increase the cost of production for manufacturers that produce several types of magnetic components with different bobbin configurations on the magnetic cores.

What is needed, then, is a magnetic component apparatus that includes a magnetic core with multiple legs, multiple bobbins, and multiple windings, where wire can be easily wound around the bobbins on the magnetic core.

BRIEF SUMMARY OF THE INVENTION

The present invention includes an interconnectable bobbin apparatus that can be placed on one leg of a magnetic core, and which can be selectively connectable to a second bobbin located on another leg of the magnetic core. The present invention also includes a magnetic component apparatus which utilizes interconnectable bobbins.

One embodiment of an interconnectable bobbin includes a bobbin body that can be located on one leg of a multiple leg magnetic core. The bobbin body has a first end flange and a second end flange, the first and second end flanges being opposite one another. A fastener is configured on the first end flange. The fastener is positioned to engage a second bobbin which can be located on an adjacent leg of the magnetic core. In one embodiment, the fastener includes a protrusion extending from the first end flange of the interconnectable bobbin which engages a corresponding recess in the second bobbin.

A benefit of such an embodiment of an interconnectable bobbin apparatus is that each bobbin can be wound separately and independently. The bobbins and windings can then be assembled by connecting the bobbins together by their respective fasteners to form the general magnetic component shape or structure. The magnetic core can then be inserted through the bobbins to form the assembled magnetic component.

Another benefit of some embodiments of an interconnectable bobbin structure is related to manufacturing. In contrast to conventional structures that are made with the magnetic core and bobbins as one structure, the interconnectable bobbin and the magnetic cores can be manufactured separately. Conventionally, each bobbin for different bobbin locations on the magnetic core must be manufactured as a unique unit. However, in some embodiments of the present invention, manufacturers can make a large number of identical interconnectable bobbin structures, assemble them into a variety of different bobbin configurations, and then insert the magnetic core through the connected bobbins to complete the assembly. This may alleviate the need to make unique molds for different bobbin configurations on a magnetic core.

Another aspect of the invention is a magnetic component apparatus that utilizes the interconnectable bobbin apparatus. The magnetic component structure generally includes a magnetic core with a first leg and a second leg. The first leg of the magnetic core extends into a first bobbin having a first axial passage. A first winding can be placed on the first bobbin. The second leg of the magnetic core extends into a second bobbin having a second axial passage. A second winding can be placed on the second bobbin. The first and second bobbins can be connected as described for the interconnectable bobbin apparatus.

Another aspect of the present invention is a method of constructing a magnetic component with interconnectable bobbins for winding wire around a magnetic core. The method generally includes providing a magnetic core with a first leg and a second leg. A first bobbin and a second bobbin are also provided. The first and second bobbins are connected. A magnetic core is then inserted through the bobbins, the first leg of the magnetic core being inserted through the first bobbin, and the second leg of the magnetic core being inserted through the second bobbin.

A further embodiment of the present invention provides an electronic device such as a power supply, power converter, power inverter, or transformer that utilizes a magnetic component having multiple core legs. Multiple interconnectable bobbins can be located on adjacent legs of the magnetic core and can be connected together. Windings can be located on the interconnectable bobbins.

One object of the present invention is to provide an interconnectable bobbin that can be connected with one or more other bobbins on adjacent legs of a magnetic core.

Another object of the invention is to provide an interconnectable bobbin that can be connected to one or more other bobbins to form the shape of a multiple leg magnetic core.

A further object of the invention is to provide an interconnectable bobbin that is capable of being connected with one or more other bobbins to form a variety of magnetic component bobbin configurations.

Yet another object of the invention is to provide an interconnectable bobbin that can be wound separately from the magnetic component and then connected with one or more other bobbins to form the magnetic structure.

Another object of the invention is to provide a method to easily position windings on a multiple leg magnetic core.

Still another object of the invention is to provide a magnetic component apparatus that utilizes interconnectable bobbins.

A further object of the invention is to provide a method for constructing a multiple leg magnetic component with interconnectable bobbins.

Numerous other objects, advantages and features of the present invention will be readily apparent to those of skill in the art upon a review of the following drawings and description of a preferred embodiment.

DETAILED DESCRIPTION OF THE INVENTION

The present invention provides an interconnectable bobbin apparatus that can be connected to one or more bobbins on adjacent legs of a multiple leg magnetic core. The present invention also provides a magnetic component apparatus which utilizes one or more of the interconnectable bobbins.

Figure 1:
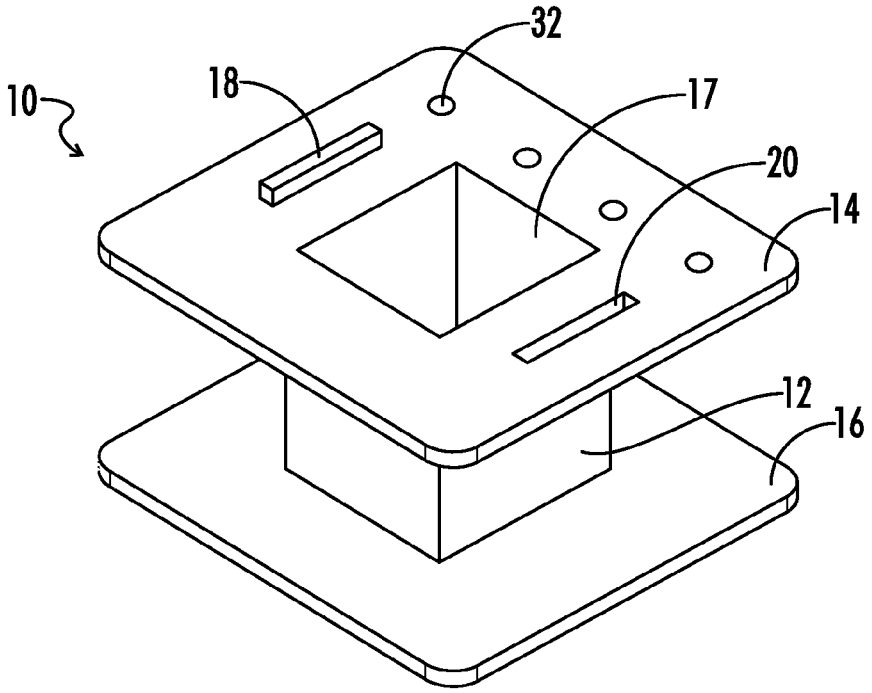
FIG. 1 is a first end perspective view of one embodiment of an interconnectable bobbin.

A first embodiment of an interconnectable bobbin apparatus 10 is shown in FIG. 1. Bobbin 10 has a bobbin body 12 which includes a first end flange 14 and a second end flange 16. An internal cavity 17 extends through the bobbin body 12, the first end flange 14, and the second end flange 16. Cavity 17 can receive a magnetic core leg. The geometry of cavity 17 can be configured to conform to the shape of a magnetic core leg. First end flange 14 and second end flange 16 are generally opposite each other on bobbin body 12. A fastener 18 is located on first end flange 14. The fastener 18 is positioned to engage a second bobbin which can be located on an adjacent leg of a magnetic core. Wire can be wound around bobbin body 12, the wire being contained by first end flange 14 and second end flange 16. First end flange 14 may also include a recess 20 opposite fastener 18.

Figure 3:
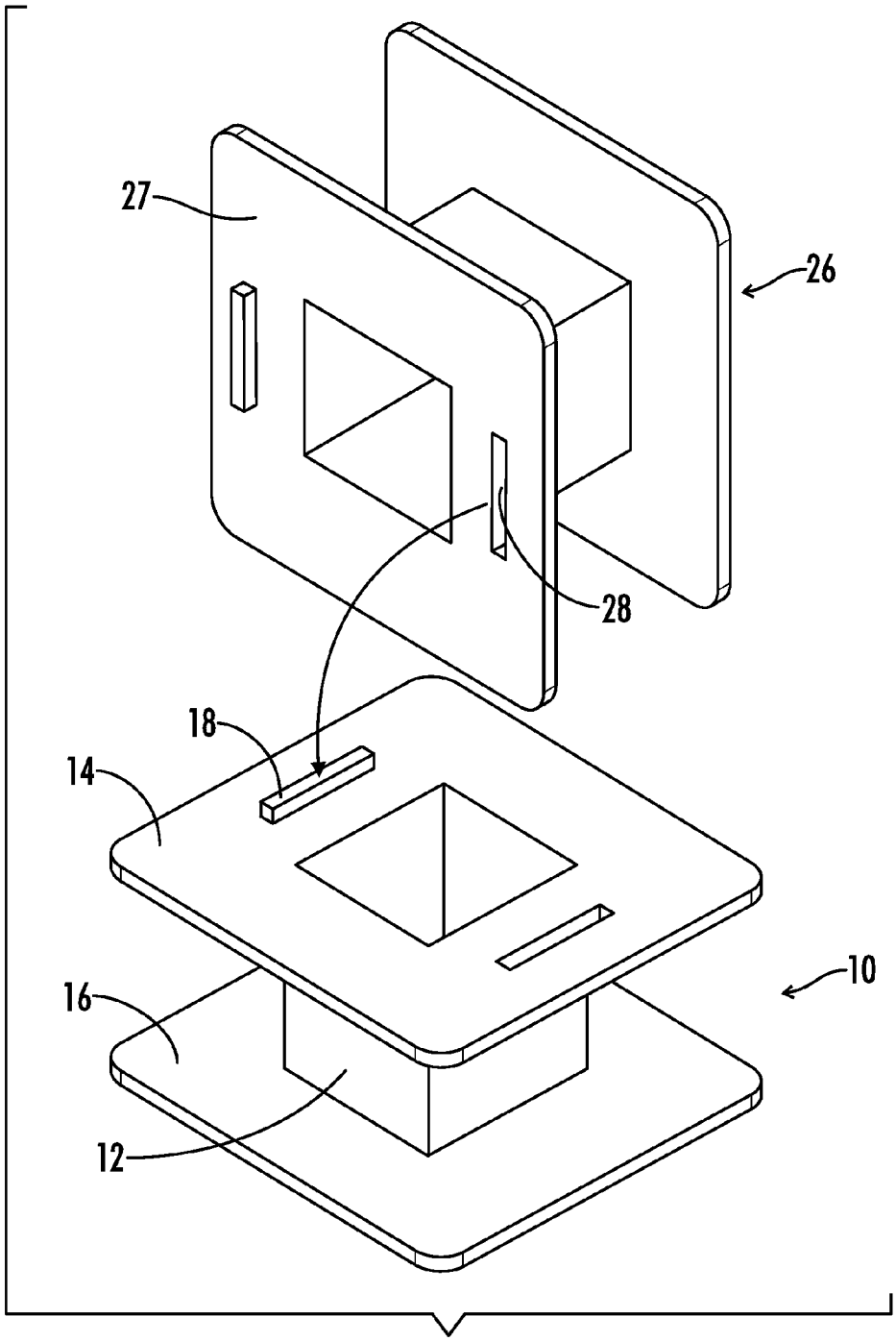
FIG. 3 is a perspective view of two interconnectable bobbins of FIGS. 1 and 2 in position for being connected together.
Figure 4:
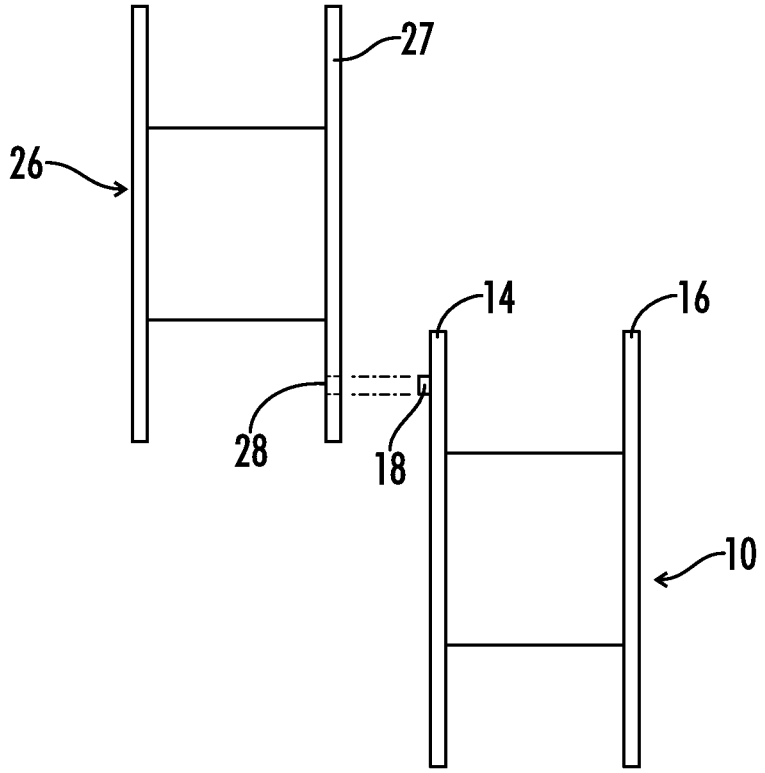
FIG. 4 is a top view of two interconnectable bobbins of FIGS. 1 and 2 being connected with one offset from the other.

FIG. 3 shows the interconnectable bobbin 10 of FIG. 1 being connected to a second interconnectable bobbin 26. Second bobbin 26 may also include an end flange 27 having a recess 28. Fastener 18 on first bobbin 10 can be positioned to engage second bobbin 26. Fastener 18 on first bobbin 10 in this embodiment engages the recess 28 on the second bobbin 26. First and second bobbins 10, 26 are thereby connected such that they are offset, thus allowing first bobbin 10 to receive one leg of a magnetic core, and second bobbin 26 to receive a second leg of a magnetic core. A top view of such a connection is seen in FIG. 4. Fastener 18 on first end flange 14 of first bobbin 10 can be inserted into recess 28 in second bobbin 26, thereby providing an offset attachment between the two bobbins.

Figure 5:
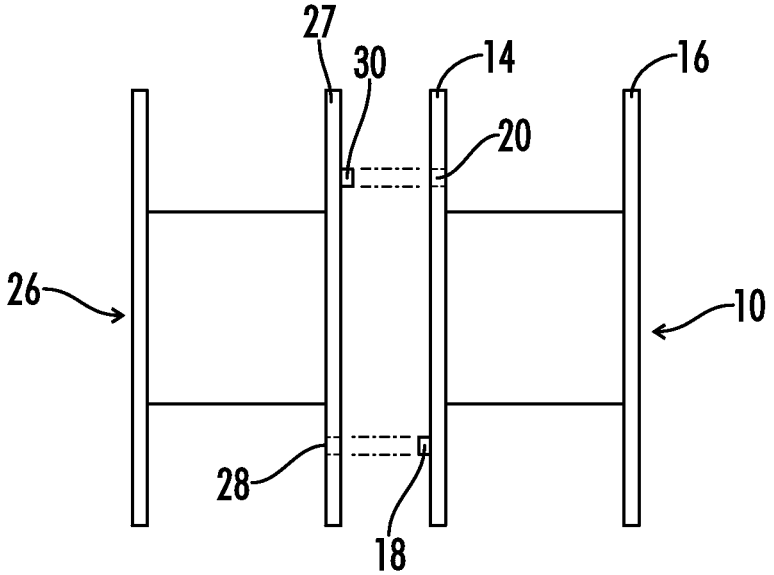
FIG. 5 is a top view of two interconnectable bobbins of FIG. 1 being connected in a linear fashion.

Additionally, second bobbin 26 may also include a fastener 30 (FIG. 5) on its end flange 27 located opposite recess 28 in second bobbin 26. The bobbins 10, 26 can then be connected axially such that they can receive the same leg of a magnetic core, as shown in FIG. 5. Fastener 18 on first bobbin 10 can be inserted into recess 28 in second bobbin 26. Fastener 30 on second bobbin 26 can be inserted into recess 20 on first bobbin 10, thereby connecting the bobbins axially or in linear series.

Figure 2:
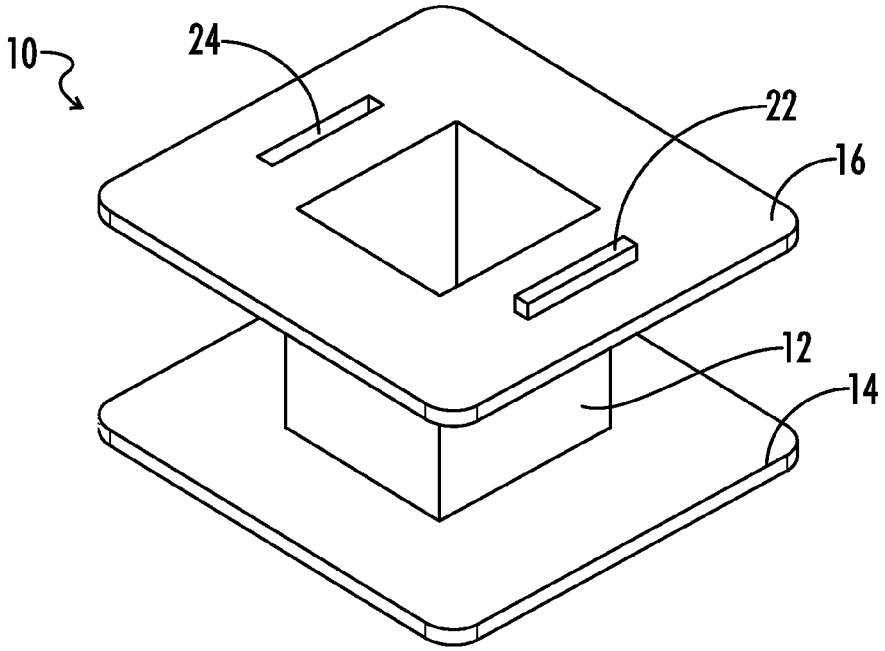
FIG. 2 is a second end perspective view of the interconnectable bobbin of FIG. 1.

A second end perspective view of interconnectable bobbin 10 in FIG. 1 is shown in FIG. 2. In some embodiments, second end flange 16 may also include a second fastener 22 and a second recess 24. Second fastener 22 and second recess 24 may be opposite each other on second end flange 16. Fastener 18, recess 20, second fastener 22, and second recess 24 on bobbin 10 can each be connected to a bobbin situated on another leg of a magnetic core as shown in FIG. 3 and previously discussed. Thus, bobbin 10 can be connected to four different bobbins situated on other legs of a magnetic core in some embodiments. The number of bobbins connected to interconnectable bobbin 10 may depend on the particular application.

Fastener 18 in the embodiment of FIG. 1 of the interconnectable bobbin 10 is shown as a protrusion extending from first end flange 14. Protrusion 18 engages a recess 28 in a second bobbin 26. Protrusion 18 may create an interference fit with recess 28 in second bobbin 26. Alternatively, the protrusion 18 can be snap-fit to recess 28 in second bobbin 26. It will be apparent to one skilled in the art that there are a number of equivalent fasteners that would be suitable for connecting first bobbin 10 and second bobbin 26 together. For example, fastener 18 can be a rod extending from first end flange 14 positioned to engage a hole in the second bobbin 26. Other suitable fasteners 18 may also include adhesives, magnets, hook and loop material, etc. These are but a few of the suitable fasteners available and those listed are not intended to be a limitation on the scope of the present invention.

Referring to FIG. 1, first end flange 14 may include at least one hole 32 to be used as a passage for wire going between first bobbin 10 and second bobbin 26, for instance if the two windings are to be wired together. Hole 32 may also be used as a termination site for connecting bobbin 10 to a printed circuit board. Additionally, the at least one hole 32 can be located on second end flange 16.

A benefit of such an interconnectable bobbin 10 is that it allows each bobbin to be wound independently and separate from an overall magnetic component assembly. Winding the bobbins independently can be easier and less complicated than attempting to wind a bobbin already fixed to a magnetic core. After the desired number of bobbins have been wound, the bobbins can be connected together in a variety of arrangements which can be suitable for a variety of applications. A magnetic core can then be inserted into the bobbins to complete the assembly of a magnetic component. An interconnectable bobbin can save substantial time during the manufacturing process in some embodiments because the bobbins can be wound and then can be quickly assembled together with a magnetic core.

A second manufacturing advantage to an interconnectable bobbin 10 is that it eliminates the need to manufacture, through molding or otherwise, a specific magnetic component for each bobbin configuration. Because the interconnectable bobbins can be connected together to form a large number of different bobbin configurations, a manufacturer can produce or mold multiple interconnectable bobbins with a common design. The bobbins can then be connected together to form a variety of magnetic components as previously described, thereby reducing the number and variety of unique molds needed, which may reduce overall manufacturing costs.

Figure 6:
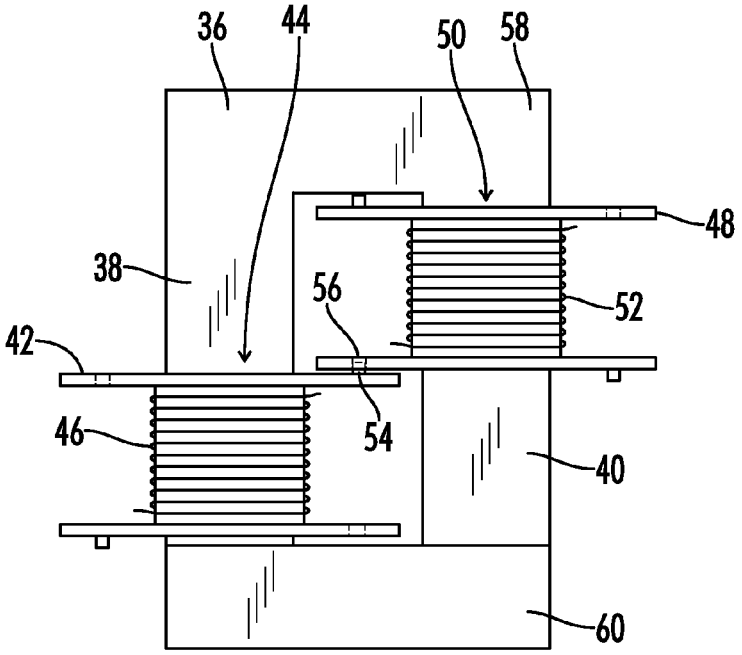
FIG. 6 is a top view of one embodiment of a magnetic component having two bobbins interconnected on multiple core legs.

A second aspect of the present invention includes a magnetic component apparatus that includes multiple interconnectable bobbins similar to the embodiment of FIG. 1. One embodiment of a magnetic component apparatus 34 is illustrated in FIG. 6. Magnetic component 34 includes a core 36 having a first leg 38 and a second leg 40. A first bobbin 42 has a first axial passage 44. First leg 38 of magnetic core 36 extends into first axial passage 44. A first winding 46 is placed on first bobbin 42. A second bobbin 48 has a second axial passage 50. Second leg 40 of magnetic core 36 extends into second axial passage 50. A second winding 52 is located on second bobbin 48. First bobbin 42 and second bobbin 48 are connected together. In this embodiment a protrusion 54 extends from first bobbin 42, and a recess 56 is located on second bobbin 48. The first and second bobbins 42, 48 are connected by inserting the protrusion 54 into the recess 56. Alternatively, protrusion 54 on first bobbin 42 could be a rod that is inserted through a hole in second bobbin 48. The first and second bobbins 42, 48 can also be connected using suitable fasteners 18 such as adhesives, magnets, or hook and loop materials.

In the embodiment of FIG. 6, the magnetic core may include a C core 58 and an I-core 60. The C-core 58 is inserted through first and second bobbins 42, 48 and mated with I-core 60 to form the magnetic core 36. Alternatively, magnetic core 36 can include two C-cores mated together.

Figure 7:
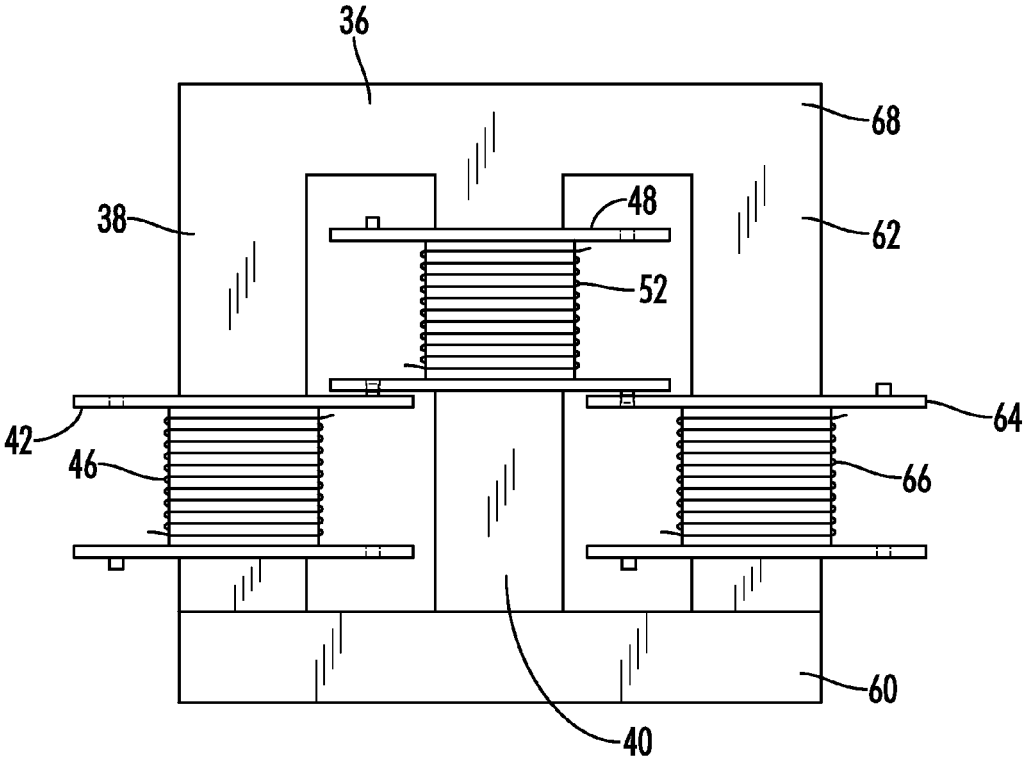
FIG. 7 is a side view of a second embodiment of a magnetic component apparatus having three bobbins interconnected on multiple core legs.

A second embodiment of a magnetic component apparatus 34 is seen in FIG. 7. In this embodiment, magnetic core 36 may include a third leg 62. Magnetic component 34 may include a third bobbin 64. A third winding 66 may be located on third bobbin 64. Third leg 62 of magnetic core 36 extends into third bobbin 64. Third bobbin 64 can be connected to second bobbin 48 located on second leg 40 of magnetic core 36.

Magnetic core 36 in FIG. 7 may include a first E-core 68 and an I-core 60, the E-core 68 being inserted through the three bobbins 42, 48, 64 and mated with the I-core 60 to form the magnetic component apparatus. Alternatively, as seen in FIG. 9, magnetic core 36 may include a first E-core 68 and a second E-core 70, the two E-cores 68, 70 being inserted through the bobbins and mated to form the magnetic component apparatus.

Figure 8:
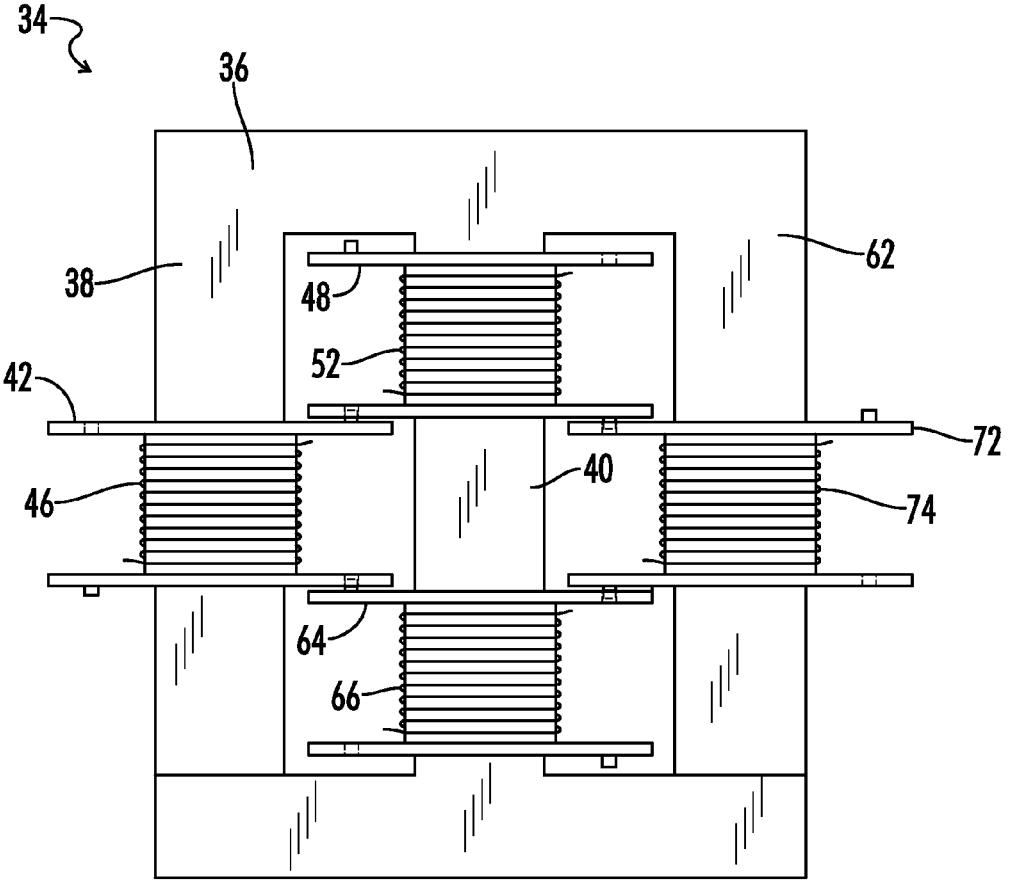
FIG. 8 is a top view of a third embodiment of a magnetic component apparatus having four bobbins interconnected on multiple core legs.

A third embodiment of a magnetic component 34 is seen in FIG. 8. This embodiment is similar to the embodiment shown in FIG. 7, but has a four bobbins and a different bobbin configuration. Third bobbin 64 and third winding 66 can be located on second leg 40 of magnetic core 36, and third bobbin 64 can be connected to first bobbin 42. Magnetic component 34 may include a fourth bobbin 72, the third leg 62 of magnetic core 36 extending into fourth bobbin 72. A fourth winding 74 may be placed on fourth bobbin 72. Fourth bobbin 72 can be connected to second bobbin 48 and third bobbin 64, the second and third bobbin 48, 64 being located on the second leg 40 of the magnetic core 36.

Figure 9:
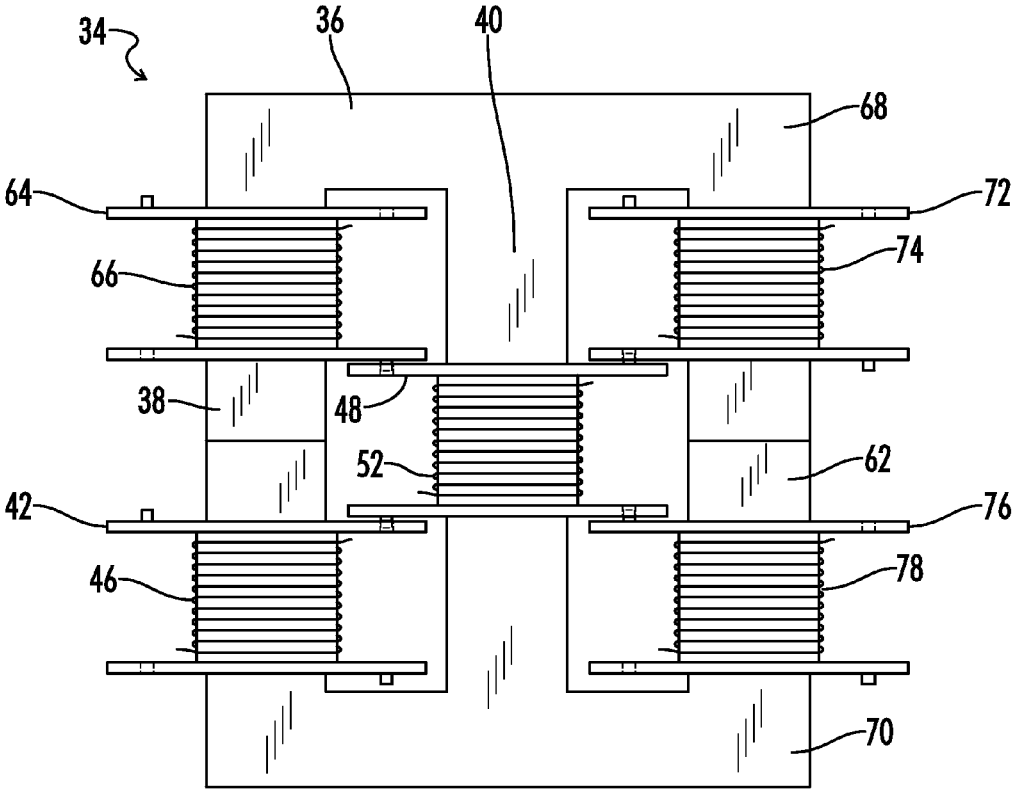
FIG. 9 is a top view of a fourth embodiment of a magnetic component apparatus having five bobbins interconnected on multiple core legs.

A fourth embodiment of a magnetic component 34 is seen in FIG. 9. This embodiment again is similar to the embodiments of FIG. 7 and FIG. 8 but has a different bobbin configuration. This embodiment includes five bobbins. Third bobbin 64 and third winding 66 can be on first leg 38 of magnetic core 36. The third bobbin 64 can be connected to second bobbin 48 located on second leg 40 of magnetic core 36. Fourth bobbin 72 and fourth winding 74 can remain on third leg 62 of magnetic core 36. Fourth bobbin 72 can be connected to second bobbin 48. Magnetic component 34 may also include a fifth bobbin 76, the third leg 62 of magnetic core 36 extending into fifth bobbin 76. A fifth winding 78 may be placed on the fifth bobbin 76. Fifth bobbin 76 can be connected to the second bobbin 48 in some embodiments.

Figure 10:
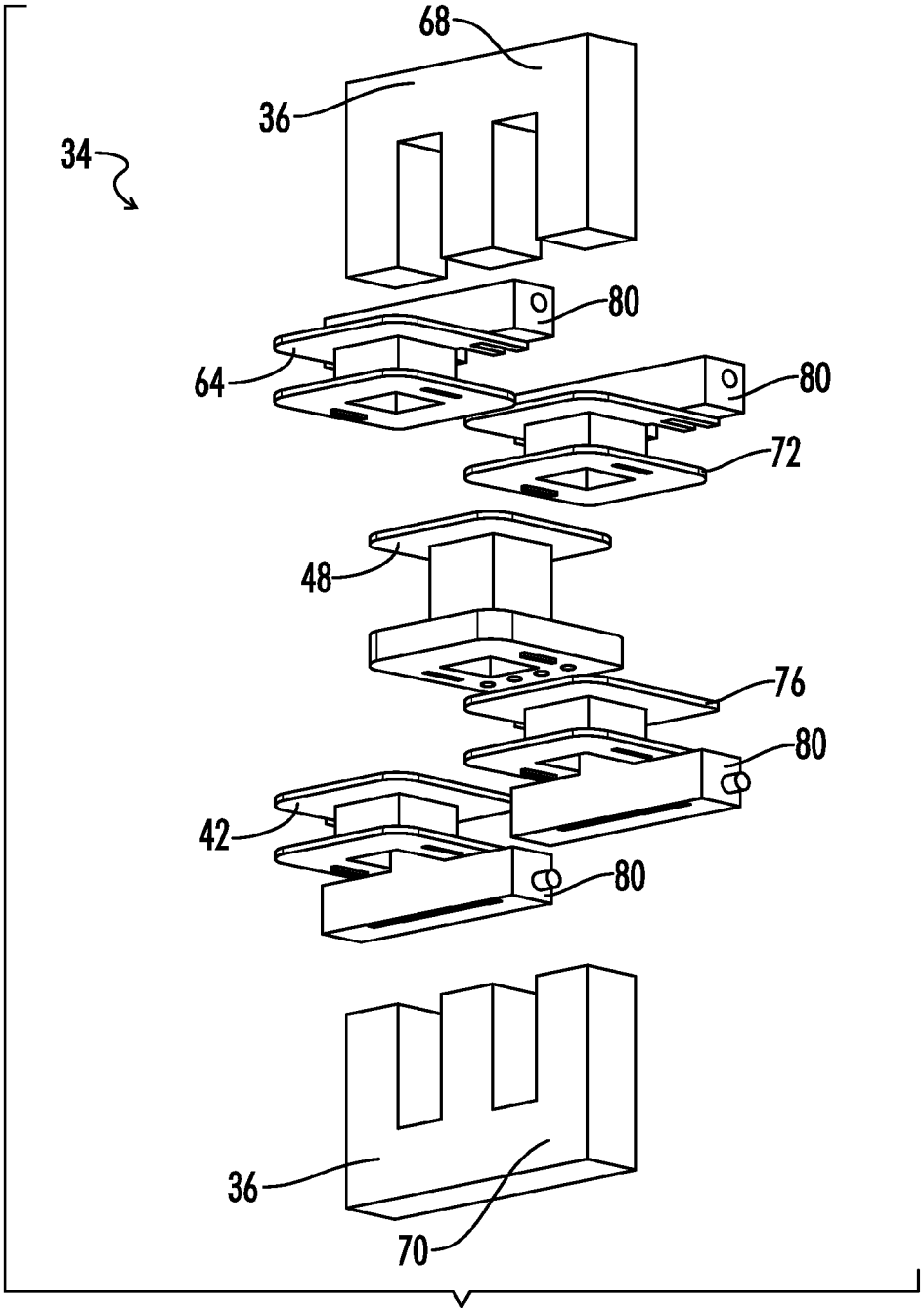
FIG. 10 is an exploded perspective view of an embodiment of a magnetic component apparatus having multiple bobbins on different core legs.
Figure 11:
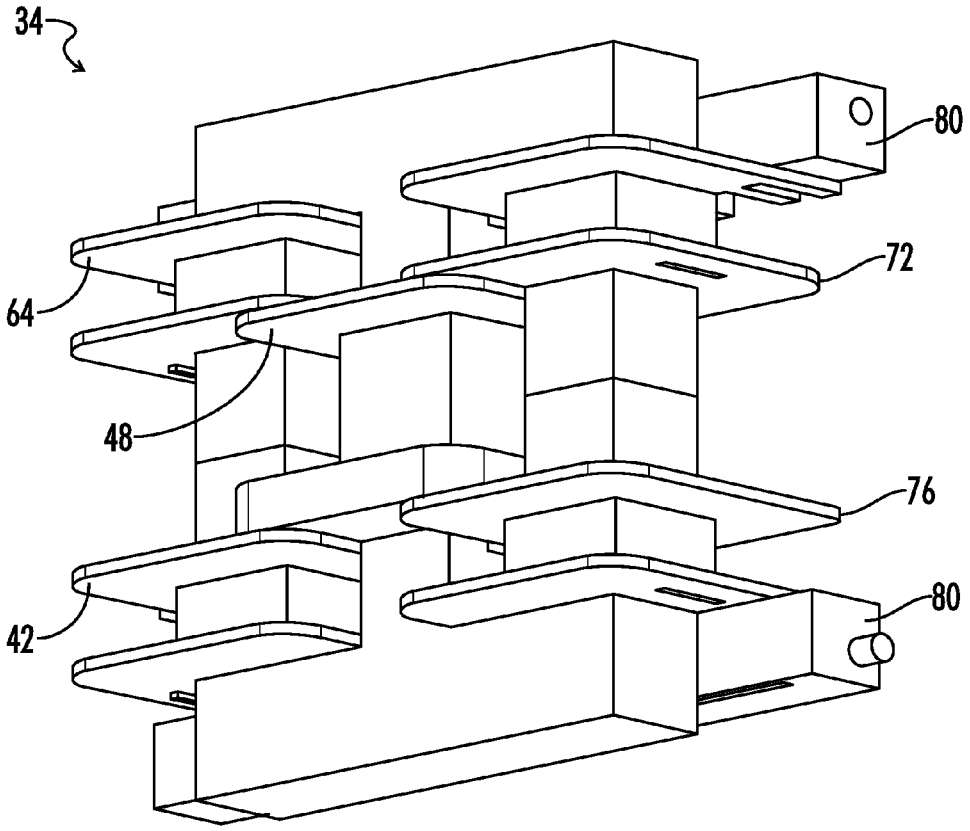
FIG. 11 is a perspective view of the embodiment of an assembled magnetic component apparatus of FIG. 10.

A perspective exploded view of an embodiment of a magnetic component apparatus is shown in FIG. 10. The five bobbins 42, 48, 64, 72, 76 can be connected as described, and once the bobbins are connected, first E-core 68 and second E-core 70 can be inserted through the bobbins and mated to form magnetic component apparatus 34. FIG. 10 also shows one or more of the bobbins including terminal connectors 80. Windings on the bobbins can be fed to the terminal connectors 80, and the terminal connectors 80 can then be connected to a printed circuit board. A perspective view of the assembled embodiment of FIG. 10 is seen in FIG. 11.

Figure 12:
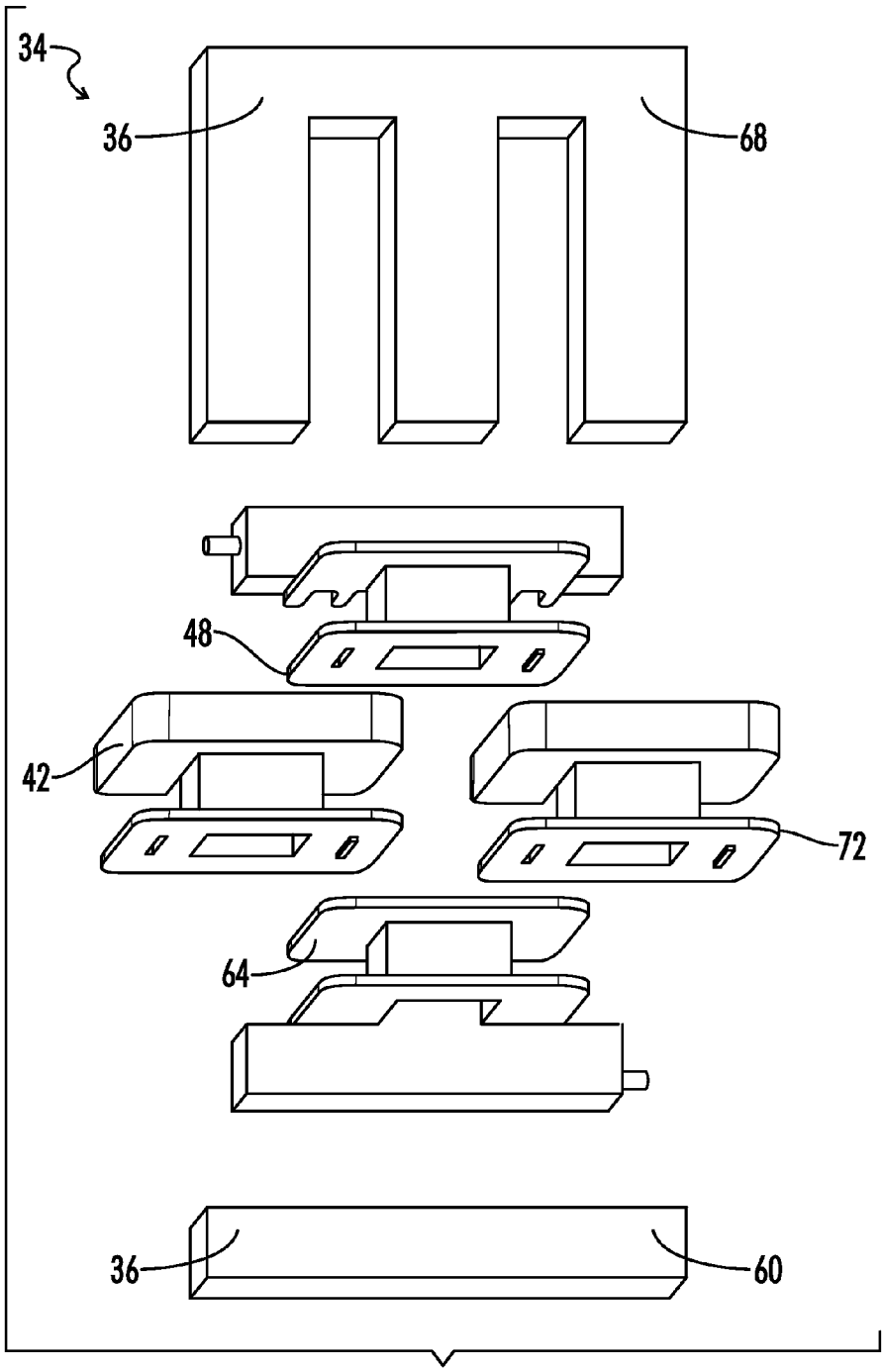
FIG. 12 is an exploded perspective view of an embodiment of a magnetic component apparatus having multiple bobbins on different core legs.
Figure 13:
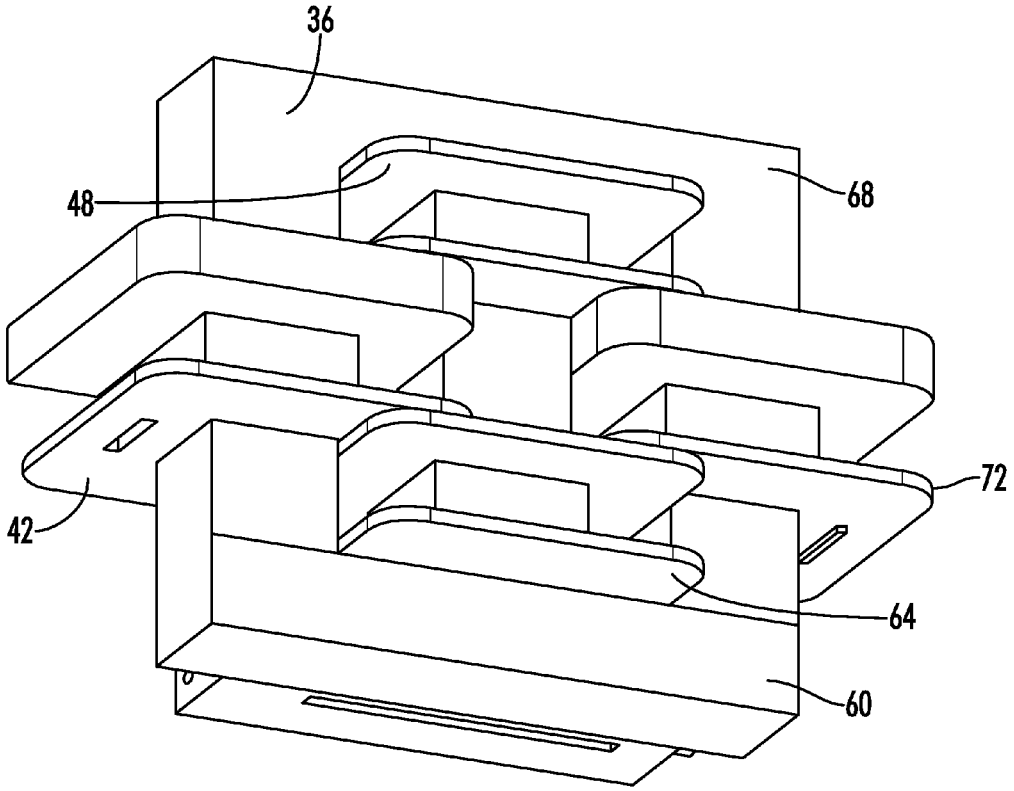
FIG. 13 is a perspective view of the embodiment of an assembled magnetic component apparatus of FIG. 12.

A perspective exploded view of another embodiment of the magnetic component apparatus 34 is shown in FIG. 12. The four bobbins 42, 48, 64, 72 can be connected as described previously. First E-core 68 can be inserted through the bobbins and mated with I-core 60 to form the assembled magnetic component 34. A perspective view of the assembled embodiment of FIG. 12 is seen in FIG. 13.

It will be apparent to one skilled in the art that there can be a large number of different configurations for the interconnectable bobbins on magnetic cores which are useful for a variety of applications. Certain bobbin configurations have been herein described, but such descriptions are not intended to be a limitation of the scope of this invention. There are many configurations not specifically mentioned that are within the scope and spirit of the present invention.

Figure 14:
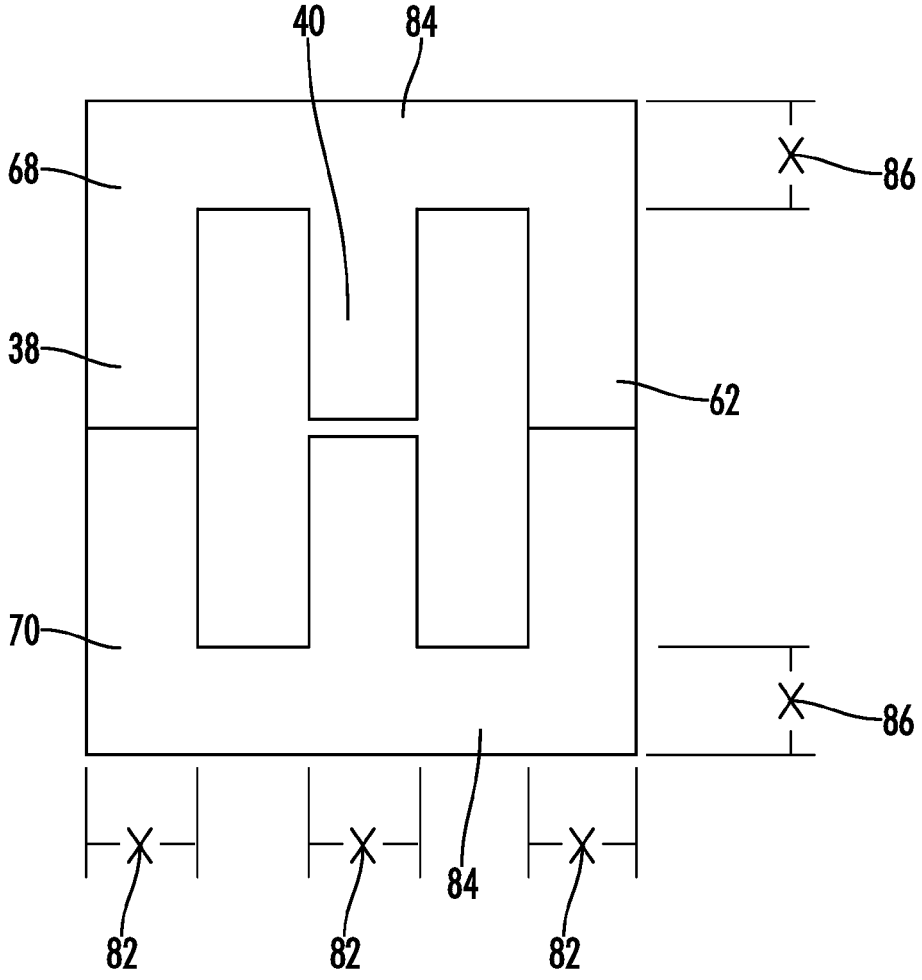
FIG. 14 is a plan view of an embodiment of a modified E core.

A view of an embodiment of a modified E-core is shown in FIG. 14. The modified E-core has modified dimensions as compared to standard E-cores used in magnetic components. In standard E-cores the inner leg of the E-core typically has a different dimension than the two outer legs. In some embodiments, the present invention provides a core wherein the first leg 38, the second leg 40, and the third leg 62 all have the same width 82 in an effort to better accommodate the magnetic fluxes generated by windings on the E-core. Back wall 84 of the modified E-core has the same width 86 as the legs of the E-core. First E-core 68 and second E-core 70 in the magnetic components herein described can have a standard shape or the modified shape previously discussed.

Another aspect of the present invention is a method for constructing a magnetic component with interconnectable bobbins for winding wire around a magnetic core. The method generally includes providing a magnetic core having a first leg and a second leg. A first bobbin and a second bobbin are provided. The first bobbin and the second bobbin are then connected. The magnetic core is inserted through the first bobbin and the second bobbin, with the first leg of the magnetic core being inserted into the first bobbin, and the second leg of the magnetic core being inserted through the second bobbin, thereby forming the assembled magnetic component. The method may also include winding a first wire around the first bobbin and winding a second wire around the second bobbin before connecting the two bobbins together. The first bobbin may further include a protrusion extending from the first bobbin and the second bobbin may further include a recess. The connecting step in the method may then further include inserting the protrusion into the recess.

This method can further include providing more than two bobbins and providing a magnetic core with more than two legs. For example, the magnetic core may include a third leg, and the method may further include providing a third bobbin, connecting the third bobbin to the second bobbin, and inserting the third leg of the magnetic core through the third bobbin. The method can be similarly extrapolated to produce a number of different magnetic components with different bobbin configurations, including the configurations previously described herein.

Thus, although there have been described particular embodiments of the present invention of a new and useful Magnetic Component Apparatus with Interconnectable Bobbins it is not intended that such references be construed as limitations upon the scope of this invention except as set forth in the following claims.

What is claimed is:

1. An interconnectable bobbin apparatus comprising a first bobbin positionable on a first leg of a multi-leg core and a second bobbin positionable on an adjacent leg of the multi-leg core, wherein the first leg and the adjacent leg are parallel and are not longitudinally aligned with each other, each of the first bobbin and the second bobbin comprising:

a bobbin body having an axial passage to receive the first leg of the multi-leg core, the axial passage extending axially from an outer face of a first end flange to an outer face of a second end flange, the second end flange positioned at an opposite end of the axial passage with respect to the first end flange, each of the first end flange and the second end flange having a respective inner face in a plane normal to the axial passage, the bobbin body configured to receive a winding wound from the inner face of the first end flange to the inner face of the second end flange; and a first fastener element on the outer face of the first end flange of one of the first bobbin and the second bobbin, the first fastener element configured to engage a second fastener element on the outer face of the first end flange of the other of the first bobbin and the second bobbin with at least a portion of the outer face of the first end flange of the first bobbin positioned against at least a portion of the outer face of the first end flange of the second bobbin and with the first fastener element of the first bobbin aligned with the second fastener element of the second bobbin.

2. The apparatus of claim 1, further comprising at least one hole through the first end flange.

3. The apparatus of claim 1, wherein the outer face of the respective first end flange of each of the first bobbin and the second bobbin has a respective one of the first fastener element and a respective one of the second fastener element, and wherein the first fastener element and the second fastener element on each outer face are positioned on either side of the axial passage.

4. The apparatus of claim 1, wherein the first fastener element comprises a protrusion extending from the outer face of the first end flange, and wherein the second fastener element comprises a recess extending inwardly from the outer face of the first end flange.

5. The apparatus of claim 1, wherein the fastener is configured to provide a snap fit.

6. The apparatus of claim 1, wherein the second end flange of each of the first bobbin and the second bobbin further comprises a respective first fastener element and a respective second fastener element, the respective second fastener element positioned opposite the respective first fastener element with respect to the axial passage.

7. A multiple bobbin magnetic component apparatus comprising:

a core having a first leg and a second leg, wherein the first leg and the second leg are parallel and are not longitudinally aligned with each other;

a first bobbin comprising:

a first flange having an outer face and an inner face;

a second flange having an outer face and an inner face, the second flange spaced apart from and parallel to the first flange;

an axial passage perpendicular to and extending from the outer face of the first flange of the first bobbin to the outer face of the second flange of the first bobbin, the first leg of the core extending into the axial passage of the first bobbin;

a first winding on the first bobbin wound from the inner face of the first flange of the first bobbin to the inner face of the second flange of the first bobbin;

a first protrusion extending perpendicularly outward from the outer face of the first flange of the first bobbin; and a first recess extending perpendicularly into the first flange of the first bobbin from the outer face of the first flange of the first bobbin;

a second bobbin comprising:

a first flange having an outer face and an inner face;

a second flange having an outer face and an inner face, the second flange spaced apart from and parallel to the first flange;

an axial passage perpendicular to and extending from the outer face of the first flange of the second bobbin to the outer face of the second flange of the second bobbin, the second leg of the magnetic core extending into the axial passage of the second bobbin;

a second winding on the second bobbin wound from the inner face of the first flange of the second bobbin to the inner face of the second flange of the second bobbin;

a first protrusion extending perpendicularly outward from the outer face of the first flange of the second bobbin; and a first recess extending perpendicularly into the first flange of the second bobbin from the outer face of the first flange of the second bobbin, wherein the first bobbin is connected to the second bobbin with at least a portion of the outer face of the first flange of the first bobbin positioned against at least a portion of the outer face of the first flange of the second bobbin, and with the first protrusion of the first flange of one of the first bobbin and the second bobbin extending into and engaging with the first recess of the first flange of the other of the first bobbin and the second bobbin.

8. The apparatus of claim 7, further comprising a third bobbin, wherein:

the third bobbin comprises:

a first flange with an outer face and an inner face;

a second flange with an outer face and an inner face;

an axial passage extending from the outer face of the first flange to the outer face of the second flange;

a winding wound around the axial passage from the inner face of the first flange to the inner face of the second flange;

a protrusion extending from the outer face of the first flange; and a recess in the outer face of the first flange;

the first bobbin further comprises:

a second protrusion on the second flange of the first bobbin, the second protrusion extending perpendicularly outward from the outer face of the second flange of the first bobbin; and a second recess in the second flange of the first bobbin, the second recess extending perpendicularly into the second flange of the second bobbin from the outer face of the second flange of the second bobbin;

the second leg of the magnetic core extends into the axial passage of the third bobbin; and the third bobbin is connected to the first bobbin with either:

the protrusion on the outer face of the first flange of the third bobbin extending into and engaging with the recess in the outer face of the second flange of the first bobbin; or the protrusion on the outer face of the second flange of the first bobbin extending into and engaging with the recess in the outer face of the first flange of the third bobbin.

9. The apparatus of claim 8, wherein the magnetic core further comprises a third leg, and wherein the apparatus further comprises a fourth bobbin, wherein:

the fourth bobbin comprises:

a first flange with an outer face and an inner face;

a second flange with an outer face and an inner face;

an axial passage extending from the outer face of the first flange to the outer face of the second flange;

a winding wound around the axial passage from the inner face of the first flange to the inner face of the second flange;

a first protrusion extending from the outer face of the first flange;

a first recess in the outer face of the first flange;

a second protrusion extending from the outer face of the second flange;

a second recess in the outer face of the second flange;

the third leg of the magnetic core extends into the axial passage of the fourth bobbin; and the fourth bobbin is connected to both the second bobbin and the third bobbin with either:

the protrusion on the outer face of the first flange of the fourth bobbin extending into and engaging with the recess in the outer face of the first flange of the second bobbin; or the protrusion on the outer face of the first flange of the second bobbin extending into and engaging with the recess in the outer face of the first flange of the fourth bobbin;

and with either:

the protrusion on the outer face of the second flange of the fourth bobbin extending into and engaging with the recess in the outer face of the first flange of the third bobbin; or the first protrusion on the outer face of the first flange of the third bobbin extending into and engaging with the second recess in the outer face of the second flange of the fourth bobbin.

10. The apparatus of claim 9, wherein the first leg, the second leg and the third leg are parallel and no leg is longitudinally aligned with any other leg.

11. A method of constructing a magnetic component with interconnectable bobbins for winding wire around a magnetic core, the method comprising:

providing a core having a first leg and a second leg, wherein the first leg and the second leg are parallel and are not longitudinally aligned with each other;

providing a first bobbin and a second bobbin, each of the first bobbin and the second bobbin having first and second flanges, each of the first and second flanges of each of the first and second bobbins having a respective outer face and a respective inner face, wherein a respective axial passage extends from the respective outer face of the first flange to the respective outer face of the second flange, and wherein a respective wire is wound on each bobbin from the respective inner face of the respective first flange to the respective inner face of the respective second flange, each respective outer face of each respective first flange having a first fastener element and a second fastener element;

connecting the first bobbin to the second bobbin by engaging the first fastener element of the respective outer face of the respective first flange of one of the first bobbin and the second bobbin with the second fastener element of the respective outer face of the respective first flange of the other of the first bobbin and the second bobbin, the first bobbin and the second bobbin positioned with at least a portion of the respective outer face of the respective first flange of the first bobbin positioned against at least a portion of the respective outer face of the respective first flange of the second bobbin;

inserting the first leg of the core through the axial passage of the first bobbin; and inserting the second leg of the core through the axial passage of the second bobbin.

12. The method of claim 11 wherein the core further comprises a third leg and the method further comprises:

providing a third bobbin having first and second each of the first and second flanges of the third bobbin having a respective outer face and a respective inner face, wherein a respective wire is wound on third bobbin from the respective inner face of the first flange to the respective inner face of the second flange, the first outer face of the third bobbin having a first fastener element and a second fastener element;

connecting the third bobbin to the second bobbin by:

positioning at least a portion of the outer face of the first flange of the third bobbin against at least a portion of the outer face of the first flange of the second bobbin, and either engaging the first fastener element of the outer face of the first flange of the third bobbin with the second fastener element of the outer face of the first flange of the second bobbin or engaging the second fastener element of the outer face of the first flange of the third bobbin with the first fastener element of the outer face of the first flange of the second bobbin;

and inserting the third leg of the core through the third bobbin.

13. The apparatus of claim 12, wherein the first leg, the second leg and the third leg are parallel and no leg is longitudinally aligned with any other leg.

* * * * *